US007894756B2

(12) United States Patent
Aikawa

(10) Patent No.: US 7,894,756 B2
(45) Date of Patent: Feb. 22, 2011

(54) IMAGE FORMATION DEVICE

(75) Inventor: Kiyofumi Aikawa, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/504,343

(22) Filed: Jul. 16, 2009

(65) Prior Publication Data

US 2009/0304418 A1 Dec. 10, 2009

Related U.S. Application Data

(62) Division of application No. 11/251,903, filed on Oct. 18, 2005, now Pat. No. 7,580,661.

(30) Foreign Application Priority Data

Feb. 22, 2005 (JP) ..... 2005-045807

(51) Int. Cl.
*G03G 15/01* (2006.01)

(52) U.S. Cl. ..... 399/301; 399/72; 399/372

(58) Field of Classification Search ..... 399/72, 399/301, 372

See application file for complete search history.

(56) References Cited

U.S. PATENT DOCUMENTS 6,456,310 B1 9/2002 Wallace et al.

2006/0088344 A1* 4/2006 Aikawa ..... 399/301

FOREIGN PATENT DOCUMENTS

| | | |
|---|---|---|
| JP | 64-006981 A | 1/1989 |
| JP | 10-213940 | 8/1998 |
| JP | 2003-295560 A | 10/2003 |

OTHER PUBLICATIONS

Office Action issued in JP Application No. 2005-045807 on May 18, 2010 (with English translation).

Office Action issued in JP Application No. 2005-045807 on Oct. 12, 2010 (with English translation).

* cited by examiner

*Primary Examiner*—Ryan D Walsh
(74) *Attorney, Agent, or Firm*—Oliff & Berridge, PLC

(57) ABSTRACT

An image formation device has an image formation section, a pattern image detection section and a registration correction section. The image formation section forms an image to be outputted and a pattern image on an image-bearing body, the pattern image is formed at a non-image creation region outside an image creation region at which the outputted image is formed. The pattern image detection section detects a position of the pattern image for detecting positional offset of the image. The registration correction section corrects the positional offset based on the detected position of the pattern image.

3 Claims, 4 Drawing Sheets

IMAGE FORMATION DEVICE

CROSS-REFERENCE TO RELATED APPLICATION

This is a Division of application Ser. No. 11/251,903 filed Oct. 18, 2005, which in turn claims priority under 35 USC 119 from Japanese Patent Application No. 2005-45807 filed Feb. 22, 2005, the disclosure of which is incorporated by reference herein in its entirety.

BACKGROUND

1. Technical Field

The present invention relates to an image formation device which, with plural image-forming sections, forms respective single-color images on an image-bearing body and superposes the plural single-color images on the image-bearing body to form an output image.

2. Related Art

An example of a tandem-type color image formation device for outputting color images is provided with respective image formation sections for each of the colors yellow (Y), magenta (M), cyan (C) and black (K). At each of these image formation sections, a respective toner image of the color Y, M, C or K is formed on a photosensitive body, such as a photosensitive drum or the like. A color image (output image) is formed by sequentially transferring these toner images onto a common image creation region of an intermediate transfer body, such as an intermediate transfer belt or the like, and overlaying the toner images. The output image that has been formed on this intermediate transfer body is transferred and fixed onto a recording medium, such as recording paper or the like, and outputted to outside the device.

Now, with a tandem-type color image formation device as described above, positional offsets when the toner images of the respective colors are superposed on the intermediate transfer body may be discerned as color registration error image faults (defects) in color images, or as reductions in image quality which result from color registration errors. Accordingly, a technology has been proposed (see Japanese Patent No. 2,765,606) in which, at predetermined times such as immediately after a power supply is turned on or prior to the commencement of image formation, pattern images for detection of color registration errors (i.e., registration control patterns) are sequentially formed at the intermediate transfer body by the image formation sections of the respective colors. Positions of these registration control patterns are respectively detected by an optical sensor or the like. On the basis of the detection values, image-writing timings (exposure commencement timings) of images onto the photosensitive drums by the image formation sections are feedback-controlled. Thus, color registration errors between the toner images of the respective colors are eliminated.

However, with a tandem-type color image formation device as described above, periods in which it is possible to feedback-control timings of commencement of exposure onto the photosensitive drums by the image formation sections, in accordance with registration control pattern detection values, are limited to periods in which no effect will be exerted on image quality, such as, for example: a period immediately after power to the device is turned on; a period prior to formation of an output image; a period in which a non-image creation region (an inter-image region) between plural image creation regions (page regions) formed at the intermediate transfer body is passing an image formation section which is the object of feedback control; and suchlike.

Therefore, in a case of forming an image at a long strip of continuous paper, if the image has a large image size in a sub-scanning direction, that is, if there is no margin to the image along a length dimension, color registration errors between the single-color images may gradually progressively increase during image formation, and image quality near a trailing end of an output image may be lower than near a leading end.

Furthermore, if a color registration error in an output image is detected during the formation of an image which is long along a sub scanning direction, correcting the color registration error (i.e., a positional offset of the toner images), by altering a timing of writing of an image by an image formation section that is an object of feedback control, during formation of the image, may be considered. However, if a correction amount applied to a toner image is large, a location at which the correction is applied may be discerned in the output image as an obvious defect, and there may be a deterioration in image quality.

SUMMARY

An image formation device has an image formation section, a pattern image detection section and a registration correction section. The image formation section forms an image to be outputted and a pattern image on an image-bearing body, the pattern image is formed at a non-image creation region outside an image creation region at which the outputted image is formed. The pattern image detection section detects a position of the pattern image for detecting positional offset of the image. The registration correction section corrects the positional offset based on the detected position of the pattern image.

BRIEF DESCRIPTION OF THE DRAWINGS

Embodiments of the invention will be described in detail with reference to the following figures, wherein.

DETAILED DESCRIPTION

Below, image formation devices relating to embodiments of the present invention will be described with reference to the drawings.

First Embodiment

Figure 1:
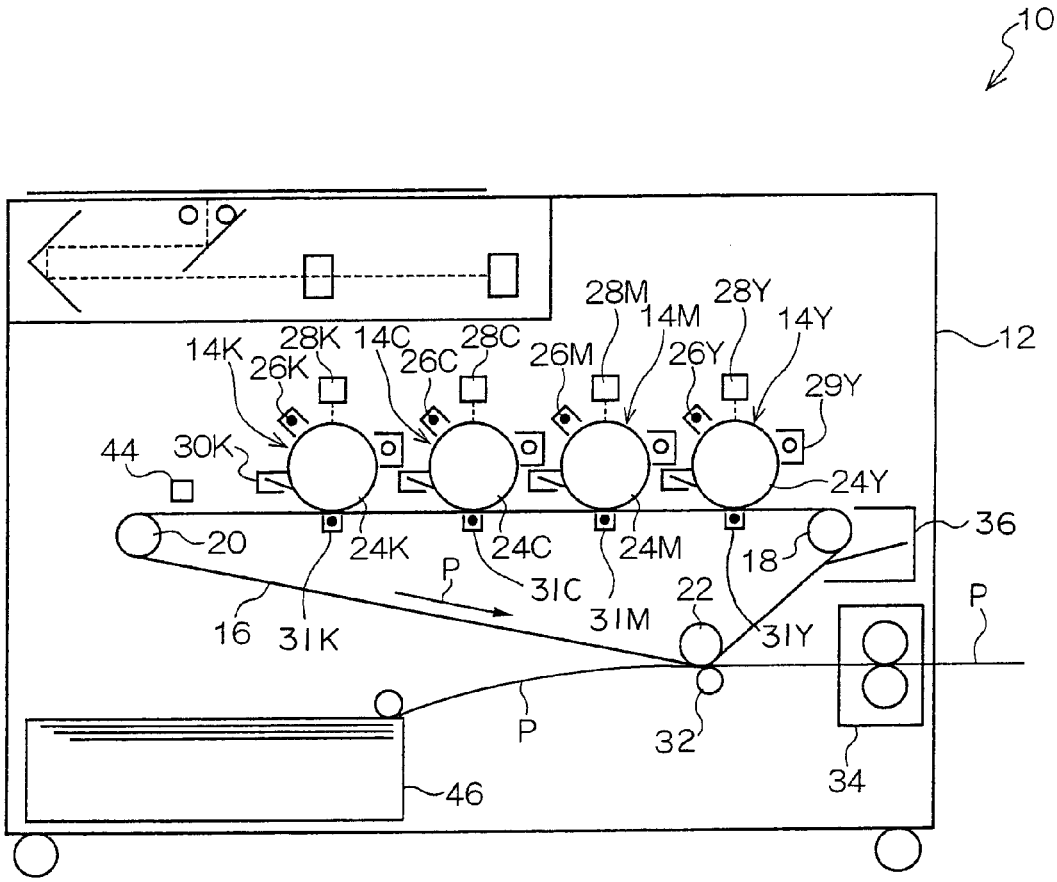
FIG. 1 is a side view showing general structure of a color printer relating to a first embodiment of the present invention.

FIG. 1 shows a tandem-type color printer 10 relating to a first embodiment of the present invention. This color printer 10 is provided with a casing 12, which serves as an enclosure portion. Image formation units 14Y, 14M, 14C and 14K, which correspond respectively to the four colors yellow (Y), magenta (M), cyan (C) and black (K), are provided in the casing 12. When there is no need to specify Y, M, C or K for the components structuring the device, the reference numerals Y, M, C and K which are appended to part numbers are respectively omitted.

In the color printer 10, an endless-type intermediate transfer belt 16 is provided at a lower side of the four image formation units 14. The intermediate transfer belt 16 is suspended between three rollers 18, 20 and 22. During image formation, torque is transmitted from any of the belt rollers 18, 20 and 22, and the intermediate transfer belt 16 is moved to turn in a predetermined processing direction (the direction of arrow P) by this torque. These image formation units 14Y, 14M, 14C and 14K have basically the same structure as one another, except that the colors of toner images formed on the intermediate transfer belt 16 (toner colors) are respectively different.

At each image formation unit 14, a cylindrical photosensitive drum 24, which serves as an image-bearing body, is provided. When the intermediate transfer belt 16 moves in the processing direction, the photosensitive drum 24 rotates in an image creation direction, following the intermediate transfer belt 16. At an outer peripheral side of the photosensitive drum 24 of the image formation unit 14, a charging unit for primary charging 26, an LED printer head 28, a developing unit 29, a transfer unit 31 and a drum cleaning unit 30 are provided in this order along the direction of rotation of the drum.

At a time of image formation in the color printer 10, the charging unit 26 uniformly charges a surface of the photosensitive drum 24 to a predetermined image-creation potential. Thereafter, the LED printer head 28 exposes the surface of the photosensitive drum 24 with a laser beam which is modulated in accordance with image data, and an electrostatic latent image corresponding to Y, M, C or K is formed at the surface of the photosensitive drum 24. The electrostatic latent image formed on the photosensitive drum 24 is developed to a toner image of Y, M, C or K (a single-color image) by the developing unit 29. These toner images are sequentially transferred onto the intermediate transfer belt 16 by the transfer units 31 with predetermined timings. Here, the toner images of Y, M, C and K are respectively transferred (primary transfer) onto the intermediate transfer belt 16 so as to be mutually superposed at a predetermined image creation region. Thus, a full-color toner image is formed on the intermediate transfer belt 16 at the image creation region to serve as an output image.

The toner image formed on the intermediate transfer belt 16 is transferred (secondary transfer) by a transfer roller 32 onto recording paper P, which is supplied from a paper supply unit 46. Thereafter, the toner image is fixed onto the recording paper P by a fixing unit 34, and the recording paper P is ejected to outside the casing 12. Here, as the recording paper P, the paper supply unit 46 is capable of supplying either of ordinary recording paper, with a regular size such as A4, B5 or the like, and continuous paper, which is formed as a long strip in a transport direction, to a secondary transfer position between the intermediate transfer belt 16 and the fixing unit 34. Further, toner that is left on the intermediate transfer belt 16 after the transfer of the toner image has finished is scraped off by a belt cleaning unit 36 and recovered from the intermediate transfer belt 16 to inside the belt cleaning unit 36.

Incidentally, in the present embodiment, the LED printer head 28 in which numerous LEDs are arrayed along a main scanning direction is employed as a light source device for exposure onto the photosensitive drum 24. However, the light source device for exposure is not limited to the LED printer head. An ROS with laser diodes as a light source, an LD array in which numerous laser diodes are arrayed along the main scanning direction, or the like could be employed.

Figure 2:
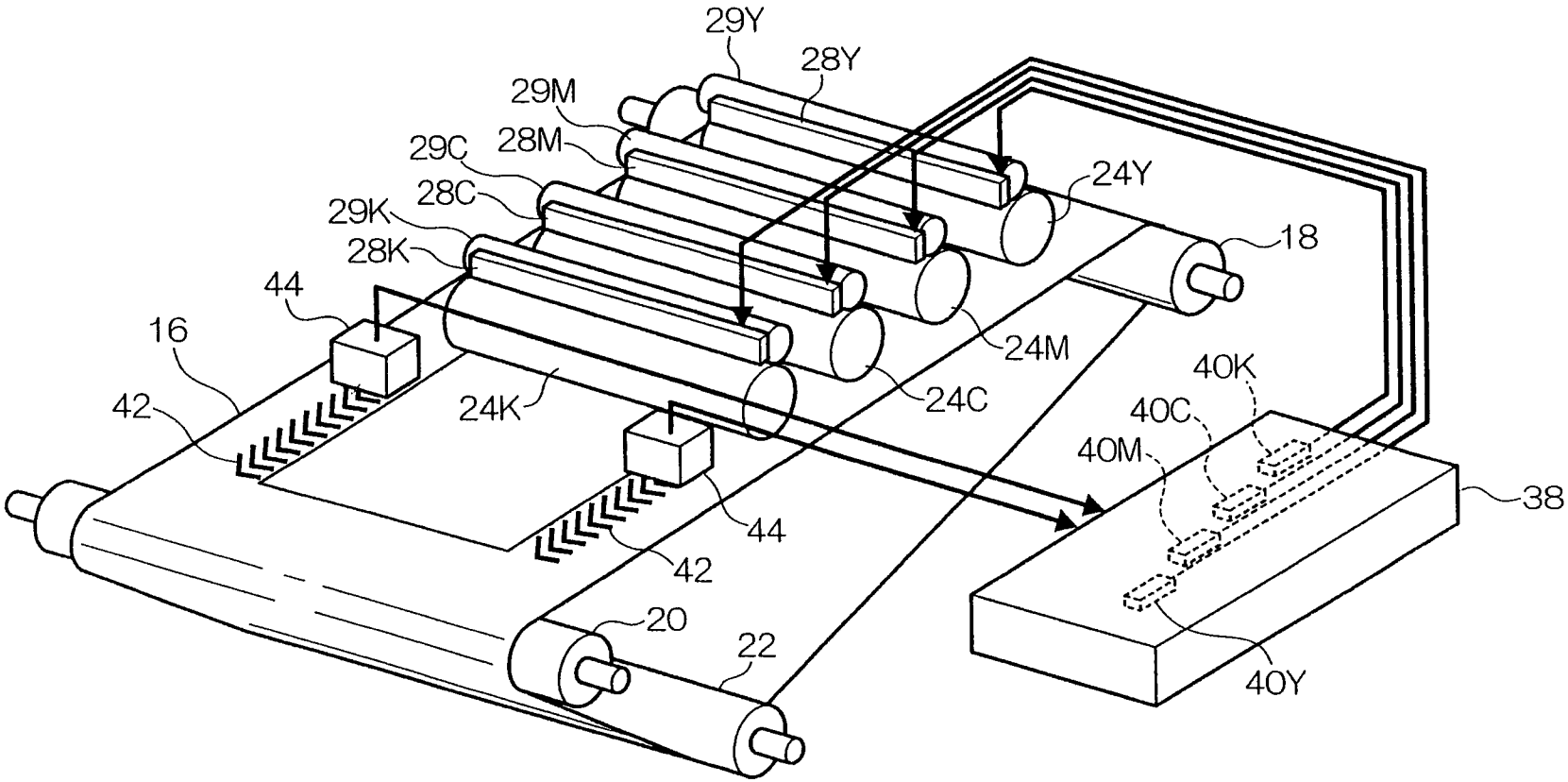
FIG. 2 is a perspective view showing structure of image formation units, an intermediate transfer belt and an image formation control section of a color printer as shown in FIG. 1.

As shown in FIG. 2, an image formation control section 38, for controlling image formation operations, is provided in the color printer 10. The image formation control section 38 is provided with four LED driving sections 40Y, 40M, 40C and 40K, which correspond to Y, M, C and K, respectively. Although not illustrated, the image formation control section 38 is also provided with a CPU, an image processing circuit, a ROM for storing image formation conditions and the like, a RAM for primary storage of image data and the like, and so forth. On the basis of color image data inputted from outside, the image formation control section 38 generates LED driving signals SG, which respectively correspond with image data of Y, M, C and K, and inputs these LED driving signals SG to the LED driving sections 40Y, 40M, 40C and 40K synchronously with a video clock. The LED driving sections 40Y, 40M, 40C and 40K receiving these LED driving signals SG cause laser beams modulated in accordance with the LED driving signals SG to be radiated from the LED printer heads 28Y, 28M, 28C and 28K. As a result, electrostatic latent images corresponding to the Y, M, C and K toner images are formed on the photosensitive drums 24Y, 24M, 24C and 24K, respectively.

In addition, the image formation control section 38 generates LED driving signals SP for formation of registration control patterns, on the basis of image data corresponding to a registration control pattern for correction of positional offsets of the toner images (below referred to as 'registration control pattern data'), which is stored in the ROM. These LED driving signals SP correspond to regions (non-image creation regions on the drums) of the photosensitive drums 24Y, 24M, 24C and 24K at outer sides in main scanning directions with respect to regions at which the images are formed by the LED driving signals SG (image creation regions on the drums). The LED driving sections 40Y, 40M, 40C and 40K receiving these LED driving signals SP cause laser beams modulated in accordance with the LED driving signals SP to be radiated from the LED printer heads 28Y, 28M, 28C and 28K, by LEDs which correspond with the non-image creation regions on the drums. As a result, electrostatic latent images corresponding to the registration control patterns are formed at the non-image creation regions on the drums of the photosensitive drums 24Y, 24M, 24C and 24K.

At the image formation units 14Y, 14M, 14C and 14K, when the electrostatic latent images corresponding to the photosensitive drums 24Y, 24M, 24C and 24K or electrostatic latent images corresponding to the image data are formed, these electrostatic latent images are developed to the Y, M, C and K toner images by the respective developing units 29.

Figure 3A:
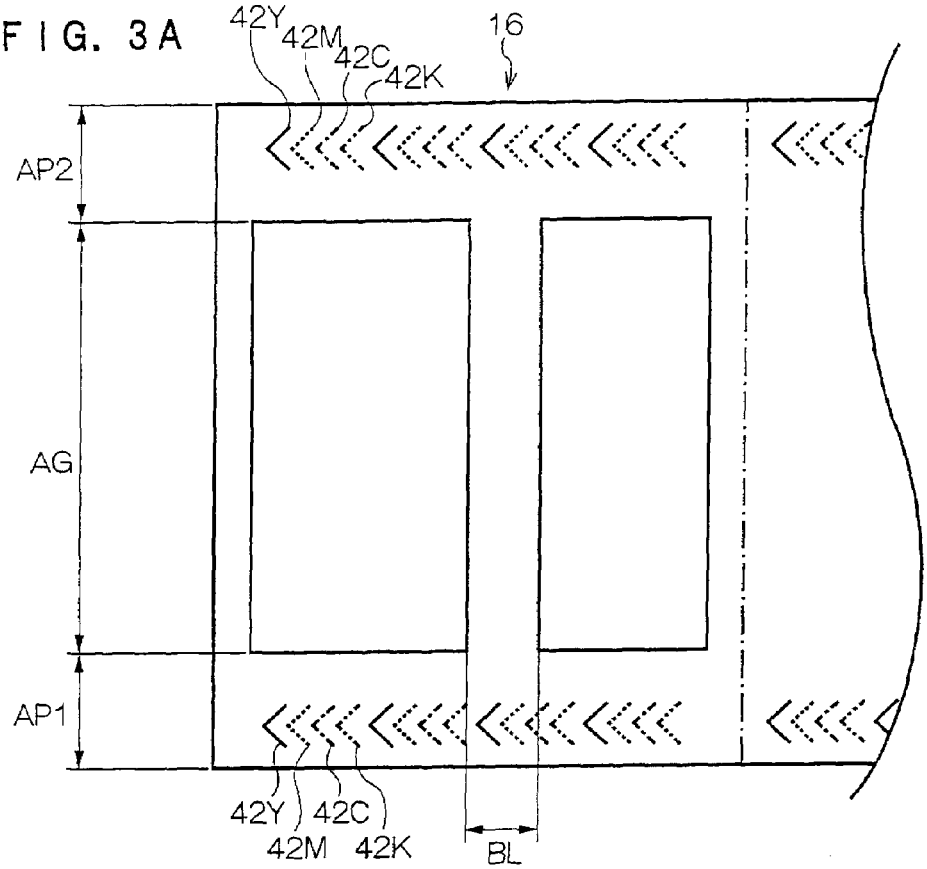
FIG. 3A is a plan view showing output images and registration control patterns which are formed on the intermediate transfer belt of the color printer as shown in FIG. 1.

The respective toner images formed at the photosensitive drums 24Y, 24M, 24C and 24K are sequentially transferred (primary transfer) onto the intermediate transfer belt 16 by the transfer units 31. Here, the Y, M, C and K toner images corresponding to the image data are transferred to the same image creation region AG on the intermediate transfer belt 16 (see FIG. 3A) and overlaid with one another. In addition, the Y, M, C and K toner images corresponding to the registration control patterns are respectively transferred to a pair of non-image creation regions AP1 and AP2 on the intermediate transfer belt 16, which are located at main-scanning direction outer sides with respect to the image creation region AG. As a result, the full-color toner image is formed at the image creation region AG and, as shown in FIG. 3A, registration control patterns 42Y, 42M, 42C and 42K of Y, M, C and K are respectively formed at the pair of non-image creation regions AP1 and AP2. Here, positions of the registration control patterns 42Y, 42M, 42C and 42K at the non-image creation regions AP1 and AP2 correspond with the positions of the Y, M, C and K toner images at the image creation region AG.

As shown in FIG. 3A, the registration control patterns 42Y, 42M, 42C and 42K are arrayed in order along the processing (belt-conveying) direction (the sub-scanning direction), and are formed such that spacings between adjacent pairs of the registration control patterns 42Y, 42M, 42C and 42K along the sub-scanning direction (i.e., pitch) are constant in an arbitrary region along the sub-scanning direction. Further, the registration control patterns 42Y, 42M, 42C and 42K have 'V' shapes as shown in FIG. 3A.

As shown in FIG. 2, a pair of registration control pattern sensors 44 are disposed at the downstream side of the image formation unit 14K so as to oppose the intermediate transfer belt 16 in the color printer 10. This pair of registration control pattern sensors 44 sequentially detects the registration control patterns 42Y, 42M, 42C and 42K formed on the intermediate transfer belt 16 during movement of the intermediate transfer belt 16 in the processing direction, and outputs position detection signals corresponding to these positions of the registration control patterns 42Y, 42M, 42C and 42K to the image formation control section 38.

On the basis of the position detection signals from the registration control pattern sensors 44, the image formation control section 38 calculates relative positional offset amounts between the Y, M, C and K toner images forming the full-color toner image. Herein, the image formation control section 38 calculates the relative positional offset amounts of the Y, M and C toner images based on a position of formation of the K toner image as a reference position. Specifically, the image formation control section 38 respectively calculates positional offset amounts along the main scanning direction, positional offset amounts along the sub-scanning direction and inclination amounts for the Y, M and C toner images by reference to the position of formation of the K toner image.

Here, positional shift amounts along the main scanning direction of the Y, M and C toner images with respect to the K toner image are calculated by comparing measurement values of spacings along the main scanning direction from the K registration control pattern 42K to the respective Y, M and C registration control patterns 42Y, 42M and 42C (measured pitches) with standard pitches of when there is no positional offset. Further, the positional shift amounts along the sub-scanning direction of the Y, M and C toner images with respect to the K toner image are calculated by finding distances between the central point of the registration control pattern 42K and the central points of the registration control patterns 42Y, 42M and 42C. Further still, inclination amounts of the Y, M and C toner images with respect to the K toner image are calculated by finding positional offset amounts along the main scanning direction between the registration control patterns 42Y, 42M, 42C and 42K formed at the non-image creation region AP1 and the registration control patterns 42Y, 42M, 42C and 42K formed at the non-image creation region AP2.

If any of the positional shift amount in the main scanning direction, the positional shift amount in the sub-scanning direction and the inclination amount of any of the Y, M and C toner images with respect to the K toner image exceeds a pre-specified threshold value (which is set to 10 μm in this embodiment), a positional offset correction is applied, in accordance with the position detection signals from the registration control pattern sensors 44, to the image formation unit 14Y, 14M or 14C at which the shift amount or inclination exceeding the threshold value has occurred.

Specifically, when the image formation control section 38 judges that a positional shift along the main scanning direction which exceeds the threshold value has occurred at the Y, M or C toner image, the image formation control section 38 calculates a correction amount and correction direction along the main scanning direction for the toner image which is the object of correction, and alters a writing position (a writing-start position) of the LED printer head 28Y, 28M or 28C onto the photosensitive drum 24Y, 24M or 24C along the main scanning direction to correspond with the calculated values of the correction amount and the correction direction by reference to a writing position of the K toner image. That is, the image formation control section 38 implements the correction by shifting an LED group of the LED printer head 28Y, 28M or 28C that is employed for exposure of the image creation region on the drum along the main scanning direction.

Figure 3B:
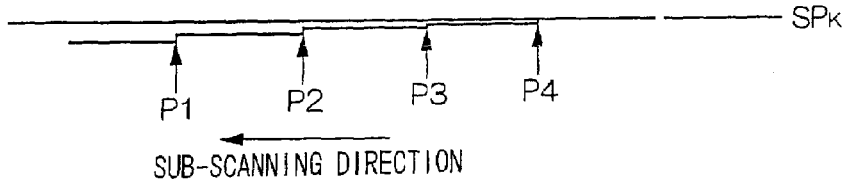
FIGS. 3B, 3C and 3D are explanatory views schematically showing corrections of Y, M, C or K toner images.

Now, in a case in which a correction amount of a writing position along the main scanning direction exceeds 10 μm, the image formation control section 38 divides single alteration operation of the writing position of the LED printer head 28Y, 28M or 28C along the main scanning direction into two or more alteration operations, along the sub-scanning direction, and implements the alteration operations in a stepwise manner. FIG. 3B schematically shows alteration operations of a writing position of the LED printer head 28Y, 28M or 28C along the main scanning direction in a case in which the correction amount of the writing position along the main scanning direction exceeds 10 μm. For example, an alteration of 19 μm in a writing position SP of Y, M or C along the main scanning direction is implemented at four correction locations along the sub-scanning direction, P1 to P4. At the correction locations P1, P2 and P3, the writing position SP is altered in 5-μm amounts such that the writing position approaches a K writing position $SP_K$, and at the correction location P4, the writing position SP is changed by 4 μm to coincide with the writing position $SP_K$.

Further, when the image formation control section 38 judges that a positional shift along the sub-scanning direction which exceeds the threshold value has occurred at the Y, M or C toner image (i.e., a main scanning line) with reference to the K toner image, the image formation control section 38 calculates a correction amount and correction direction along the sub-scanning direction for the toner image which is the object of correction, and alters (delays or advances) a writing timing of the LED printer head 28Y, 28M or 28C onto the photosensitive drum 24Y, 24M or 24C to correspond with the calculated values of the correction amount and the correction direction by reference to a writing timing of the K toner image. Thus, the image formation control section 38 implements the positional offset correction of the Y, M or C toner image in the sub-scanning direction.

Here, similarly to the case of performing a correction along the main scanning direction, in a case in which a correction amount of a main scanning line along the sub-scanning direction exceeds 10 μm, the image formation control section 38 divides single alteration operation of the writing timing of the LED printer head 28Y, 28M or 28C into two or more alteration operations, along the sub-scanning direction, and implements the alteration operations in a stepwise manner. That is, when a correction amount of the main scanning line along the sub-scanning direction exceeds 10 μm, the writing timing is altered by, for example, a clock count less than or equal to a clock count which corresponds to 5 μm at plural correction locations P1 to PN (N being a natural number), and causes the main scanning line of Y, M or C to coincide with the main scanning line of K.

Further again, when the image formation control section 38 judges that an inclination which exceeds the threshold value has occurred at the Y, M or C toner image (main scanning line) with reference to the K toner image, the image formation control section 38 calculates a correction angle and correction direction along (for) the sub-scanning direction of the toner image which is the object of correction, and gradually alters (delays or advances) a writing timing of the LED printer head 28Y, 28M or 28C onto the photosensitive drum 24Y, 24M or 24C with a gradient of alteration, from the writing position to a writing end position, which corresponds to the correction angle. Thus, the image formation control section 38 implements an inclination correction of the Y, M or C toner image.

Here, in a case in which a displacement amount along the main scanning direction of the writing end position relative to the writing position exceeds 10 μm, the image formation control section 38 divides the alteration operation of the writing timing of the LED printer head 28Y, 28M or 28C onto the photosensitive drum 24Y, 24M or 24C into two or more alteration operations, along the sub-scanning direction, and performs the alteration in a stepwise manner. That is, an inclination correction of Y, M or C is performed at plural correction locations P1 to PN (N being a natural number) which are respectively different along the sub-scanning direction, such that a displacement amount along the main scanning direction of the writing end position relative to the writing position does not exceed 10 μm in one division of the inclination correction.

Figure 3C:
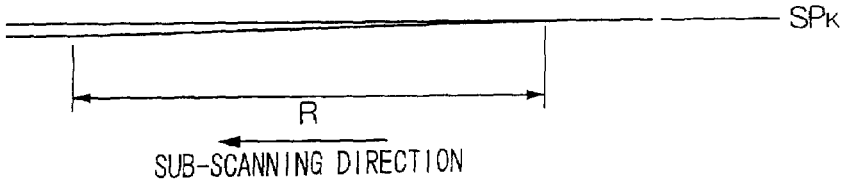

Herein, in a case in which a correction of the Y, M or C toner image with reference to the K toner image by the image formation control section 38 of a positional offset along the main-scanning direction of a positional offset along the sub-scanning direction, or of inclination is respectively greater than 10 μm, the correction is divided into N divisions and performed stepwise. However, if a correction amount of each time of a correction operation is set to a value equal to a pixel pitch of the toner image, the correction of a positional offset along the main scanning direction of Y, M or C by reference to the K toner image may be performed continuously over a correction range R which is sufficiently long in the sub-scanning direction, as shown in FIG. 3C.

Furthermore, in the color printer 10 relating to the present embodiment, main scanning direction positional offsets, sub-scanning direction positional offsets and inclinations of the Y, M and C toner images are corrected with the K toner image serving as a reference. However, it is not necessarily required that the Y, M and C toner images be corrected by reference to the K toner image. Positional corrections of the Y, M, C and K toner images may be performed by reference to another of the toner images, to reference points in the main scanning direction and the sub-scanning direction which are set at the intermediate transfer belt 16, or the like.

Further again, in the color printer 10 relating to the present embodiment, positional corrections (including inclination corrections) of the Y, M and C toner images are performed by altering writing positions or writing timings of the toner images by the LED printer heads 28Y, 28M and 28C. However, corrections may be performed by some other method. Specifically, for example, a first actuator and a second actuator are respectively provided at a frame which supports each of the LED printer heads 28Y, 28M and 28C. A position along the main scanning direction of the LED printer head 28Y, 28M or 28C is finely regulated by the first actuator, and inclination of the LED printer head 28Y, 28M or 28C with respect to the main scanning direction is finely adjusted by the second actuator. In a case in which a positional error which exceeds the predetermined threshold value has occurred according to the position detection signals from the registration control pattern sensors 44, the image formation control section 38 implements the positional correction of the Y, M, C or K toner image by driving the first actuator and/or the second actuator in accordance with calculated values of correction amount and correction direction in order to correct the positional offset. In such a case, if the correction amount exceeds 10 μm, it is required to perform the positional correction of the Y, M, C or K toner image stepwise at plural correction locations P1 to PN (N being a natural number) which are respectively different along the sub-scanning direction.

Next, operations of the color printer 10 relating to the first embodiment of the present invention will be described.

In the color printer 10 relating to the present embodiment, the four image formation units 14Y, 14M, 14C and 14K form the Y, M, C and K toner images, respectively, on the intermediate transfer belt 16 at the image creation region AG, and form the registration control patterns 42Y, 42M, 42C and 42K, respectively, at the non-image creation regions AP1 and AP2. Positions of these registration control patterns 42Y, 42M, 42C and 42K are sensed by the registration control pattern sensors 44. Hence, because the positions of the plural registration control patterns 42Y, 42M, 42C and 42K formed on the intermediate transfer belt 16 at the non-image creation regions AP1 and AP2 correspond, respectively, to the positions of the Y, M, C and K toner images formed at the image creation region AG, on the basis of the position detection data from the registration control pattern sensors 44 which have detected the positions of these registration control patterns 42Y, 42M, 42C and 42K, the image formation control section 38 can determine relative positional offset amounts between the Y, M, C and K toner images which will form the output image with good precision.

Figure 3D:
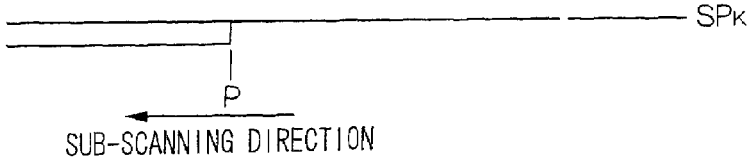

In the color printer 10, on the basis of the position detection signals from the registration control pattern sensors 44, the image formation control section 38 determines the relative positional offset amounts of the Y, M, C and K toner images which will form the output image and, if a positional offset between the Y, M, C and K toner images exceeds 10 μm, applies a positional offset correction based on the position detection signals to the image formation unit 14Y, 14M or 14C at which the positional offset exceeding 10 μm has occurred, in a stepwise or continuous manner. Accordingly, while the positional offset correction is being executed on the predetermined image formation unit 14Y, 14M or 14C, the toner image being formed by the predetermined image formation unit 14Y, 14M or 14C can be corrected so as to gradually (stepwise or continuously) approach the other toner images along the main scanning direction and/or sub-scanning direction, and ultimately coincide therewith. Therefore, even in a case in which the positional offset correction is executed at the predetermined image formation unit 14Y, 14M or 14C during formation of the output image, in comparison with a case of applying a positional offset correction to the predetermined image formation unit 14Y, 14M or 14C at a single correction position P as a single correction as shown in FIG. 3D, that is, without dividing the correction along the sub-scanning direction, it is possible to make vestiges of the positional offset correction, which will be formed in the output image when the positional offset correction is applied to the predetermined image formation unit 14Y, 14M or 14C, to be extremely inconspicuous. Thus, the occurrence of defects in output image as a result of positional offset correction can be effectively prevented.

Consequently, according to the color printer 10 relating to the present embodiment, even in a case in which an output image is formed with a long image size along a sub-scanning direction, a positional offset of a toner image that arises during formation of an output image can be corrected without a lowering of image quality that is visible to users. Thus, image quality of the output image can be effectively prevented from falling during formation of the output image.

Second Embodiment

Next, a tandem-type color printer 60 relating to a second embodiment of the present invention will be described. Herein, portions of the color printer 60 relating to the second embodiment of the present invention that are the same in structure and operation as in the color printer 10 relating to the first embodiment are assigned the same reference numerals, and descriptions thereof will be omitted.

Figure 4A:
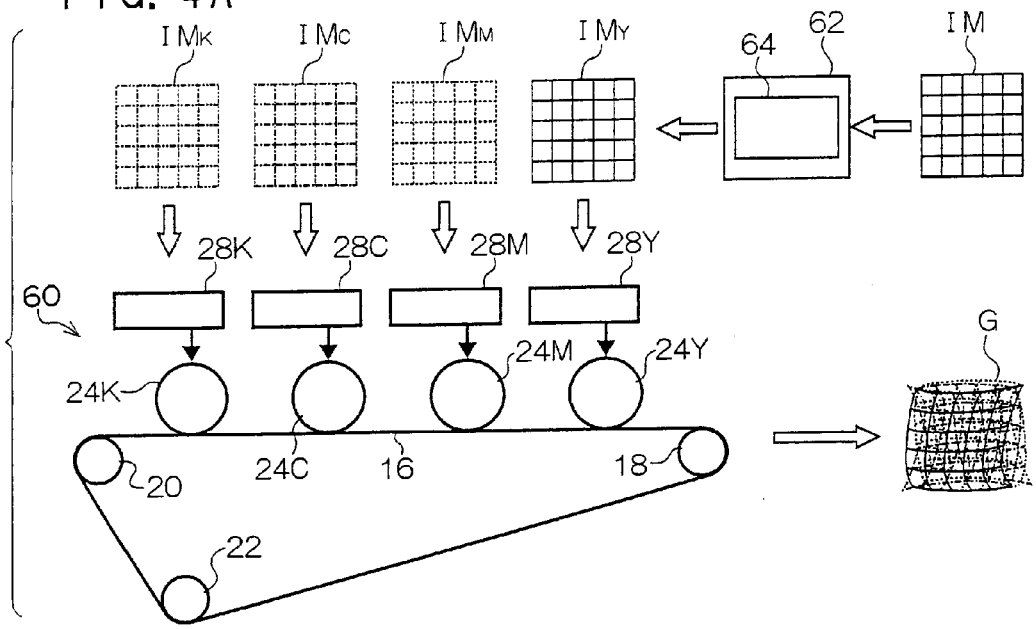
FIGS. 4A and 4B are explanatory views schematically showing general structure and input images and output images of a color printer relating to a second embodiment of the present invention.
Figure 4B:
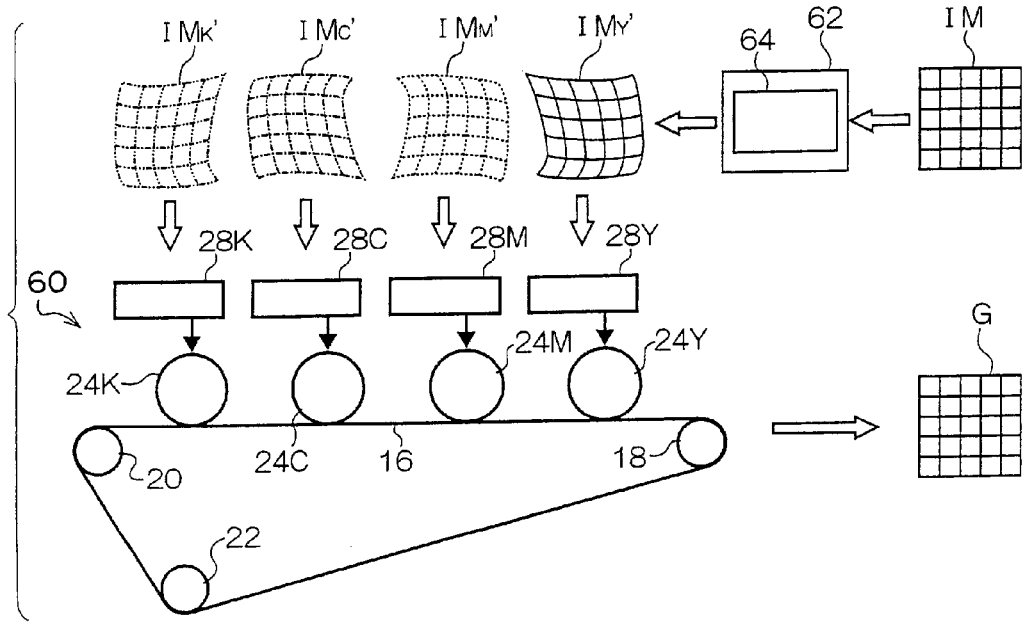

As shown in FIGS. 4A and 4B, the color printer 60 is provided with an image formation control section 62, for controlling image formation operations. This image formation control section 62 differs from the image formation control section 38 relating to the first embodiment in being provided with a video board 64, for deformation processing of positional offsets of Y, M, C and K toner images.

As shown in FIG. 4A, the image formation control section 62 forms toner images at the intermediate transfer belt 16 with the image formation units 14Y, 14M, 14C and 14K on the basis of image data sets $IM_Y$, $IM_M$, $IM_C$ and $IM_K$, respectively corresponding to Y, M, C and K, which are generated from image data IM which corresponds to a full-color image. In addition, the image formation control section 62 forms the registration control patterns 42Y, 42M, 42C and 42K (see FIG. 3A) on the intermediate transfer belt 16 with the image formation units 14Y, 14M, 14C and 14K on the basis of the registration control pattern data. Here, the image formation control section 62 temporarily inputs the image data sets $IM_Y$, $IM_M$, $IM_C$ and $IM_K$ into the video board 64 and applies deformation processing to the image data sets $IM_Y$, $IM_M$, $IM_C$ and $IM_K$ with the video board 64. Thereafter, the image formation control section 62 converts the image data sets $IM_Y$, $IM_M$, $IM_C$ and $IM_K$ to LED driving signals and inputs the LED driving signals to the LED driving sections 40Y, 40M, 40C and 40K (see FIG. 2).

During image formation on the intermediate transfer belt 16, in accordance with position detection signals from the registration control pattern sensors 44 which detect the registration control patterns 42Y, 42M, 42C and 42K, the image formation control section 62 calculates positional correction amounts along the main scanning direction, positional correction amounts along the sub-scanning direction and inclination amounts respectively for the Y, M, C and K toner images, which are formed on the intermediate transfer belt 16 on the basis of the image data sets $IM_Y$, $IM_M$, $IM_C$ and $IM_K$. Here, when respective main scanning direction positional offsets, sub-scanning direction positional offsets and inclinations occur at the respective Y, M, C and K toner images, the toner image (output image) G that is formed on the intermediate transfer belt 16 and in which Y, M, C and K are mutually overlaid is lowered in quality by color registration errors in which the Y, M, C and K toner images do not coincide, as shown in FIG. 4A.

If any of the positional offset amount along the main scanning direction, the positional offset amount along the sub-scanning direction or the inclination amount of the Y, M, C or K toner image exceeds 10 μm, the image formation control section 62 inputs correction signals corresponding to the main scanning direction positional offset amount, sub-scanning direction positional offset amount and inclination amount for each of the Y, M, C and K toner images into the video board 64 during a predetermined correction period. The video board 64, receiving these correction signals, performs deformation processing on the image data sets $IM_Y$, $IM_M$, $IM_C$ and $IM_K$ so as to respectively counter the main scanning direction positional offsets, the sub-scanning direction positional offsets and the inclinations, converts the deformation-processed image data sets $IM_Y'$, $IM_M'$, $IM_C'$ and $IM_K'$ (see FIG. 4B) to LED driving signals, and inputs these LED driving signals to the LED driving sections 40Y, 40M, 40C and 40K. Accordingly, the LED driving sections 40Y, 40M, 40C and 40K drive the LED printer heads 28Y, 28M, 28C and 28K on the basis of the deformation-processed image data sets $IM_Y'$, $IM_M'$, $IM_C'$ and $IM_K'$, and electrostatic latent images corresponding to the image data sets $IM_Y'$, $IM_M'$, $IM_C'$ and $IM_K'$ are formed by exposure onto the respective photosensitive drums 24Y, 24M, 24C and 24K by laser beams from the LED printer heads 28Y, 28M, 28C and 28K.

As a result, positional offsets in the main scanning direction, positional offsets in the sub-scanning direction and inclinations are respectively corrected in the electrostatic latent images formed in accordance with the image data sets $IM_Y'$, $IM_M'$, $IM_C'$ and $IM_K'$. Thus, in the toner image (output image) G which is formed on the intermediate transfer belt 16 and in which the Y, M, C and K toner images are mutually overlaid, the toner images coincide with one another and the output image G has higher image quality, as shown in FIG. 4B.

When the image formation control section 62 relating to the present embodiment detects, from the position detection signals from the registration control pattern sensors 44, that a positional offset exceeding 10 μm has occurred at one or other of the Y, M, C and K toner images, rather than immediately implementing a positional offset correction of the Y, M, C or K toner image, the image formation control section 62 performs a correction only within the predetermined correction period.

Specifically, after the image formation control section 62 has detected the occurrence of a positional offset exceeding 10 μm at any one of the Y, M, C and K toner images, for a positional offset correction to the image formation unit 14Y, 14M, 14C or 14K at which the positional offset exceeding 10 μm has occurred, the image formation control section 62 inputs the correction signals corresponding to the positional offset amount in the main scanning direction, the positional offset amount in the sub-scanning direction and the inclination amount of the Y, M, C or K toner image to the video board 64 during a period in which a region on the photosensitive drum corresponding to a color-blank region BL (see FIG. 3A) in toner image (single-color image) that is formed by that image formation unit 14Y, 14M, 14C or 14K is passing a position of exposure by the LED printer head 28Y, 28M, 28C or 28K (which is the correction period). Thus, a positional offset which occurs at one of the Y, M, C or K toner image is corrected only within the region on the photosensitive drum corresponding to the color-blank region BL, in which that toner image (color component) in the output image is not included.

Next, operations of the color printer 60 relating to the second embodiment of the present invention will be described.

In the color printer 60 relating to the present embodiment, the four image formation units 14Y, 14M, 14C and 14K form the Y, M, C and K toner images, respectively, on the intermediate transfer belt 16 at the image creation region AG, and form the registration control patterns 42Y, 42M, 42C and 42K, respectively, at the non-image creation regions AP1 and AP2. These registration control patterns 42Y, 42M, 42C and 42K are sensed by the registration control pattern sensors 44. Hence, because the positions of the registration control patterns 42Y, 42M, 42C and 42K formed on the intermediate transfer belt 16 at the non-image creation regions AP1 and AP2 correspond, respectively, to the positions of the Y, M, C and K toner images formed at the image creation region AG, on the basis of the position detection signals from the registration control pattern sensors 44 which have detected the positions of these Y, M, C and K registration control patterns 42Y, 42M, 42C and 42K, the image formation control section 62 can determine relative positional offset amounts between the Y, M, C and K toner images which will form the output image with good precision.

In the color printer 60 relating to the present embodiment, on the basis of the position detection signals from the registration control pattern sensors 44, the image formation control section 62 determines the relative positional offset amounts of the Y, M, C and K toner images which will form the output image and, if a relative positional offset between the Y, M, C and K toner images which exceeds a threshold value of 10 μm occurs, the image formation control section 62 applies a positional offset correction to the image formation unit 14Y, 14M, 14C or 14K at which this positional offset exceeding 10 μm has occurred, in accordance with the position detection signals, during the correction period in which the region on the photosensitive drum corresponding to the color-blank region BL in the toner image that is formed by that image formation unit 14Y, 14M, 14C or 14K is passing through the exposure position of the LED printer head 28Y, 28M, 28C or 28K. Accordingly, the toner image being formed by the predetermined image formation unit 14Y, 14M, 14C or 14K can be corrected at the region on the photosensitive drum corresponding to the color-blank region BL, which does not include that color of toner image (color component) along the sub-scanning direction, so as to coincide with the other toner images without any error. Therefore, even in a case in which the positional offset correction is executed at the predetermined image formation unit 14Y, 14M, 14C or 14K during formation of output image, in comparison with a case of applying a positional offset correction to the predetermined image formation unit 14Y, 14M, 14C or 14K within an image creation region on the photosensitive drum which region contains that color component, it is possible to make vestiges of the positional offset correction, which will be formed in the output image, when the positional offset correction is applied to the predetermined image formation unit 14Y, 14M, 14C or 14K, to be extremely inconspicuous.

Consequently, according to the color printer 60 relating to the present embodiment, even in a case in which an output image is formed with a long image size along a sub-scanning direction, a positional offset of a toner image that arises during formation of an output image can be corrected without a lowering of image quality that is visible to users. Thus, image quality of the output image can be effectively prevented from falling during formation of the output image.

Now, in the color printer 60 relating to the present embodiment, the positional offset correction applied to the image formation unit 14Y, 14M, 14C or 14K at which a positional error exceeding 10 μm has occurred is performed by deformation-processing the image data sets $IM_Y$, $IM_M$, $IM_C$ and $IM_K$ into the image data sets $IM_Y'$, $IM_M'$, $IM_C'$ and $IM_K'$ with the video board 64. However, similarly to the case of the color printer 10 relating to the first embodiment, it is also possible to implement positional offset corrections by altering writing positions and writing timings of main scanning lines by the LED printer heads 28Y, 28M, 28C and 28K, and/or to implement displacements of the LED printer heads 28Y, 28M, 28C and 28K in directions to counter the positional offsets with first actuators and second actuators.

Further, in the color printers 10 and 60 relating to the first and second embodiments, a threshold value for initiation of correction is set to 10 μm, and positional offset corrections are applied to the image formation units 14Y, 14M, 14C and 14K when positional offsets of 10 μm occur at any of the Y, M, C and K toner images. However, the threshold value for initiation of correction may be set to an arbitrary value in accordance with required image quality and the like. Moreover, the threshold value for initiation of correction may be automatically changeable in accordance with switches in output resolution.

As described above, an image formation device is capable of effectively preventing image quality of an output image from deteriorating as a result of a positional offset of single-color images which structure the output image, even when an output image with an image size which is long in a sub-scanning direction is being formed.

An image formation device of a first aspect of the present invention is an image formation device which superposes plural single-color images on an image-bearing body for forming an output image on the image-bearing body, the image formation device having plural image formation sections, each forming a predetermined single-color image so as to be superposed with another single-color image on the image-bearing body, and each forming a pattern image for positional offset detection on the image-bearing body, at a non-image creation region outside an image creation region at which the output image is formed; a pattern image detection section, which detects positions of the plural pattern images which are respectively formed at the non-image creation region by the plural image formation sections, and generates position detection data corresponding to the positions of the plural pattern images; and a registration correction section which, on the basis of the position detection data, detects a relative positional offset amount between the plural single-color images forming the output image, and divides a positional offset correction with respect to the image formation section, at which a relative positional offset exceeding a predetermined threshold value occurs, into plural positional offset corrections so as to carry out the plural positional offset corrections in stepwise or continuous manner for the relative positional offset exceeding a predetermined threshold value.

In the image formation device of the first aspect, the plural image formation sections respectively form single-color images at the image creation region on the image-bearing body, and form the respective pattern images for detection of positional offsets at the non-image creation region. Positions of these plural pattern images are detected by the pattern image detection section. Hence, because positions of the plural pattern images formed at the non-image creation region of the image-bearing body respectively correspond with positions of the plural single-color images formed at the image creation region, the registration correction section can, on the basis of the position detection data from the pattern image detection section which has detected the positions of the plural pattern images, determine relative positional offset amounts between the plural single-color images which will form the output image.

Further, in the image formation device of the first aspect, based on the position detection data from the pattern image detection section, the registration correction section detects a positional offset amount between the single-color images which will form the output image, and divides a positional offset correction with respect to the image formation section, at which a relative positional offset exceeding a predetermined threshold value occurs, into plural positional offset corrections so as to carry out the plural positional offset corrections in stepwise or continuous manner for the relative positional offset exceeding a predetermined threshold value in accordance with the position detection data. Thus, when a positional offset correction is performed on a predetermined image formation section, the single-color image that is being formed by the predetermined image formation section can be gradually (stepwise or continuously) corrected along a main scanning direction and/or a sub-scanning direction so as to approach the other single-color image(s) and ultimately coincide therewith. Therefore, even when a positional offset correction is performed on a predetermined image formation section during formation of an output image, it is possible to make vestiges of the positional offset correction, which are formed in the output image when the positional offset correction is being applied to the predetermined image formation section, to be extremely inconspicuous, in comparison with a case in which a positional offset correction is applied to the predetermined image formation section all at one time, that is, without being dispersed along the sub-scanning direction.

Consequently, according to the image formation device of the first aspect, even in a case in which an output image is formed with a long image size along a sub-scanning direction, a positional offset of a predetermined single-color image that arises during formation of the output image can be corrected without a lowering of image quality that is visible to users. Thus, image quality of the output image can be effectively prevented from falling during formation of the output image.

An image formation device of a second aspect of the present invention is an image formation device which superposes plural single-color images on an image-bearing body for forming an output image on the image-bearing body, the image formation device having plural image formation sections, each forming a predetermined single-color image so as to be superposed with another single-color image on the image-bearing body, and each forming a pattern image for positional offset detection on the image-bearing body, at a non-image creation region outside an image creation region at which the output image is formed; a pattern image detection section, which detects positions of the plural pattern images which are respectively formed at the non-image creation region by the plural image formation sections, and generates position detection data corresponding to the positions of the plurality of pattern images; and a registration correction section which, on the basis of the position detection data, detects a relative positional offset amount between the plural single-color images forming the output image, and applies a positional offset correction with respect to the image formation section, at which a relative positional offset exceeding a predetermined threshold value occurs, in a period in which a color-blank region, in a single-color image which is formed by the image formation section at which a relative positional offset exceeding a predetermined threshold value occurs, is passing a position of image creation by the image formation section at which a relative positional offset exceeding a predetermined threshold value occurs.

In the image formation device of the second aspect, the plural image formation sections respectively form single-color images at the image creation region on the image-bearing body, and form the respective pattern images for detection of positional offsets at the non-image creation region. Positions of these plural pattern images are detected by the pattern image detection section. Hence, because positions of the plural pattern images formed at the non-image creation region of the image-bearing body respectively correspond with positions of the plural single-color images formed at the image creation region, the registration correction section can, on the basis of the position detection data from the pattern image detection section which has detected the positions of the plural pattern images, determine relative positional offset amounts between the plural single-color images which will form the output image.

Further, in the image formation device of the second aspect, based on the position detection data, the registration correction section detects a relative positional offset amount between the single-color images which will form the output image, and applies the positional offset correction, in accordance with the position detection data, to the image formation section at which the positional offset exceeding the predetermined threshold value has occurred, during the period in which the region in a single-color image that is formed by that image formation section at which the positional offset exceeding the predetermined threshold value has occurred is passing through the image creation position of that image formation section at which the positional offset exceeding the predetermined threshold value has occurred. Thus, a predetermined single-color image that is being formed by a predetermined image formation section can be corrected, so as to accurately coincide with the other single-color image(s), at a color-blank region in which the predetermined single-color image (color component) is not included along a sub-scanning direction. Therefore, even when a positional offset correction is performed on a predetermined image formation section during formation of output images, it is possible to make vestiges of the positional offset correction, which are formed in the output image when the positional offset correction is being applied to the predetermined image formation section, to be extremely inconspicuous, in comparison with a case in which a positional offset correction is applied to the predetermined image formation section within an image creation region which contains the predetermined single-color image.

Consequently, according to the image formation device of the second aspect, even in a case in which an output image is formed with a long image size along a sub-scanning direction, a positional offset of a predetermined single-color image that arises during formation of the output image can be corrected without a lowering of image quality that is visible to users. Thus, image quality of the output image can be effectively prevented from falling during formation of the output image.

In the image formation device, the registration correction section may alter, with an image formation section at which a positional offset has occurred, at least one of a writing timing along a sub-scanning direction and a writing position along a main scanning direction of a single-color image, for applying a positional offset correction.

In the image formation device, the registration correction section may displace an image formation section at which a positional offset has occurred in a direction corresponding to at least one of a sub-scanning direction and a main scanning direction, for applying a positional offset correction.

In the image formation device, the registration correction section may deformation-process image data to be outputted to an image formation section at which a positional offset has occurred so as to correct the positional offset.

According to an image formation device relating to the present invention, even in a case in which an output image is to be formed with a long image size along a sub-scanning direction, occurrences of positional offsets of single-color images structuring this output image and falls in image quality of the output image can be effectively prevented.

In the image formation device of the first aspect, the registration correction section divides the relative positional offset exceeding a predetermined threshold value, and carries out the plural positional offset corrections in stepwise or continuous manner such that each of the divided relative positional offsets is corrected at times of respective positional offset corrections.

In the image formation device of the first aspect, each of the plural image formation sections has an exposure section, a photosensitive body and a develop section, and forms each single-color image by a latent image which is formed by the exposure section on the photosensitive body being developed by the develop section, and the registration correction section carries out the divided positional offset corrections in stepwise or continuous manner with respect to the image formation section at which the relative positional offset exceeding a predetermined threshold value occurs when the image formation section at which the relative positional offset exceeding a predetermined threshold value occurs forms a latent image on the photosensitive body thereof.

In the image formation device of the second aspect, each of the plurality of image formation sections has an exposure section, a photosensitive body and a develop section, and forms each single-color image by a latent image which is formed by the exposure section on the photosensitive body being developed by the develop section, and the registration correction section carries out the positional offset correction with respect to the image formation section at which the relative positional offset exceeding a predetermined threshold value occurs, when the image formation section at which the relative positional offset exceeding a predetermined threshold value occurs forms a latent image on the photosensitive body thereof, in a period in which a region corresponding to the color-blank region in the latent image is passing an exposure position by the exposure section thereof.

What is claimed is:

1. An image formation device comprising:

an image formation section that forms an image to be outputted and a pattern image on an image-bearing body, the pattern image being formed at a non-image creation region outside an image creation region at which the outputted image is formed;

a pattern image detection section that detects a position of the pattern image for detecting positional offset of the image;

a registration correction section that corrects the positional offset based on the detected position of the pattern image by deforming image data of the image to be outputted; and a plurality of the image formation sections, the registration correction section corrects the positional offset when a color-blank region between a single-color image and another single-color image passes a position of image creation by the image formation section.

2. An image formation device comprising:

a plurality of image formation sections, each forming a predetermined single-color image so as to be superposed with another single-color image on the image-bearing body, and each forming a pattern image for positional offset detection on the image-bearing body, at a non-image creation region outside an image creation region at which the output image is formed;

a pattern image detection section, which detects positions of the plurality of pattern images which are, respectively formed at the non-image creation region by the plurality of image formation sections, and generates position detection data corresponding to the positions of the plurality of pattern images; and a registration correction section which, on the basis of the position detection data, detects a relative positional offset amount between the plurality of single-color images forming the output image, and applies a positional offset correction with respect to the image formation section, at which a relative positional offset exceeding a predetermined threshold value occurs, in a period in which a color-blank region, in a single-color image which is formed by the image formation section at which a relative positional offset exceeding a predetermined threshold value occurs, is passing a position of image creation by the image formation section at which a relative positional offset exceeding a predetermined threshold value occurs.

3. The image formation device of claim 2, wherein the registration correction section deforms image data, which is to be outputted to the image formation section at which the positional offset occurs, so as to correct the positional offset.

* * * * *